US010864402B2

(12) United States Patent
Laurence

(10) Patent No.: US 10,864,402 B2
(45) Date of Patent: Dec. 15, 2020

(54) MULTIPLE FUNCTION EXERCISE DEVICE

(71) Applicant: Y Bell Group Pty Ltd, Chatswood (AU)

(72) Inventor: Aaron Laurence, Vaucluse (AU)

(73) Assignee: Y Bell Group Pty Ltd, Chatswood (AU)

( * ) Notice: Subject to any disclaimer, the term of this patent is extended or adjusted under 35 U.S.C. 154(b) by 0 days.

(21) Appl. No.: 16/321,193

(22) PCT Filed: Jul. 21, 2017

(86) PCT No.: PCT/AU2017/050750
§ 371 (c)(1),
(2) Date: Jan. 28, 2019

(87) PCT Pub. No.: WO2018/018071
PCT Pub. Date: Feb. 1, 2018

(65) Prior Publication Data

US 2019/0168060 A1 Jun. 6, 2019

(30) Foreign Application Priority Data

Jul. 28, 2016 (AU) ..... 2016902979

(51) Int. Cl.
*A63B 21/072* (2006.01)
*A63B 21/06* (2006.01)

(52) U.S. Cl.
CPC ..... *A63B 21/0726* (2013.01); *A63B 21/06* (2013.01); *A63B 21/072* (2013.01); *A63B 21/0728* (2013.01)

(58) Field of Classification Search
CPC ... A63B 21/0726; A63B 21/072; A63B 21/06; A63B 21/0728; A63B 21/4035; A63B 2220/17; A63B 2225/50; A63B 2220/40; A63B 24/0003; A63B 21/4033
See application file for complete search history.

(56) References Cited

U.S. PATENT DOCUMENTS

D271,407 S * 11/1983 Wright ..... D21/682
4,854,573 A * 8/1989 Johannson ..... A63B 23/12 482/141
D315,003 S * 2/1991 Huang ..... D21/682
5,779,604 A * 7/1998 Towley, III ..... A63B 21/0728 482/107
7,468,025 B2 12/2008 Hauser et al.
7,553,259 B2 6/2009 Landfair
8,382,647 B1 2/2013 Hodes et al.
8,454,485 B1 6/2013 Hodes et al.
9,011,300 B2 4/2015 Hodes et al.
D805,140 S 12/2017 Hodes et al.
D878,496 S * 3/2020 Hoppe ..... D21/680
(Continued)

*Primary Examiner* — Loan B Jimenez
*Assistant Examiner* — Andrew M Kobylarz
(74) *Attorney, Agent, or Firm* — Kohn & Associates, PLLC

(57) ABSTRACT

An exercise device including two load bearing plates, each of which has a curved regular convex triangular face with a center region and a peripheral region, a plurality of peripheral handles, each connecting to the peripheral region of the load bearing plates, an inner handle connecting to the center region of the load bearing plates, such that each of the peripheral handle and the inner handle has a longitudinal axis that is parallel to one another.

21 Claims, 5 Drawing Sheets

(56) References Cited

U.S. PATENT DOCUMENTS

| | | | | |
|---|---|---|---|---|
| D891,539 | S * | 7/2020 | Sun | D21/681 |
| 2007/0238578 | A1* | 10/2007 | Landfair | A63B 21/072 482/44 |
| 2011/0045956 | A1* | 2/2011 | Colledge | A63B 21/0728 482/107 |
| 2012/0178597 | A1* | 7/2012 | Januszek | A63B 21/0724 482/108 |
| 2012/0258846 | A1* | 10/2012 | Wilson | A63B 21/0004 482/141 |
| 2013/0059701 | A1 | 3/2013 | Santa Cruz et al. | |
| 2013/0288859 | A1* | 10/2013 | Watterson | A63B 24/0062 482/8 |
| 2013/0288862 | A1* | 10/2013 | Lien | A63B 21/0726 482/108 |

* cited by examiner

MULTIPLE FUNCTION EXERCISE DEVICE

BACKGROUND OF THE INVENTION

1. Technical Field

The invention relates to an exercise device and more particularly to a portable handheld exercise device which can be used as an exercise apparatus for different types of resistance training exercises.

2. Background Art

Dumbbell and kettlebell are two common resistance training exercise equipment. Although they are both used in resistance exercise, they are very different style of equipment.

Kettlebells usually provide a smooth handle with a hint of grittiness because the handle will be moving within the grip for ballistic exercises, like kettlebell swings, kettlebell snatches, and kettlebell cleans. Conversely, dumbbells typically have a griping surface for isolation movements like curls, front raises, and military presses. While you can use dumbbells for some ballistic movements (like snatches from the ground), they may not be as ideal for high repetition sets.

Kettlebells usually have a spherical weighted side for different type of kettlebell exercise such as the figure eight exercise and variations. The offset weight of the kettlebell, combined with its large, curved handle, allows holding it in a variety of ways. In addition, the offset weight of kettlebells allows you to rest them on the back of your arm while holding the handle.

One of the biggest differences between kettlebells and dumbbells is that the weight is offset and unbalanced. The handle of a kettlebell weighs much less than the "ball" of the kettlebell, whereas dumbbells are balanced from end to end. This offset weight makes a kettlebell more realistically similar to the use of daily tools.

A push-up bar is a structure that is placed on the floor for gripping by hands at the time of practising push-up. It features a single bar running perpendicular to the body so that when gripping it, the palms are facing the feet. Push-up handles typically are two separate pieces of equipment that are gripped with each hand. They allow changing the direction of the wrists, so the palms can face each other or the feet as you perform the push-up.

A medicine ball is used for working multiple areas of the body. The medicine ball was introduced by the ancient Greeks for therapeutic usage. It began as sand-filled ball evolved over centuries into the modern medicine ball seen in every gym and fitness facility. It is available in many different forms, made out of various materials and intended for strength, aerobics, and resistance training.

The typical medicine ball is generally larger than 10 inches diameter and has a leather upholstered surface. These balls have weights in the range from 2 pounds up to about 35 pounds. Typically, medicine ball has a round shape and adapted to be carried with two hands.

Dumbbells, kettlebells, medicine balls and push-up stands are typically designed for one type of exercise only.

US Patent Application No. 2013/0059701 discloses multi-functional hand held exercise device wherein the hand held exercise device comprises in combination a partial sphere shaped member having a top section and a bottom section, said top section having a hand grip thereon for manual manipulation thereof and said bottom section when positioned on a surface and manually manipulated via said hand grip allows for non-stabilized side to side, vertical and horizontal movement simultaneously thereof upon said flat surface. However, this device does not have a center bar to provide a balance weight around the grip.

U.S. Pat. No. 7,468,025 discloses a push-up exercise unit, comprising: a pair of rotatable devices, one for each hand. Each device includes: a handle support structure configured as a single moulded housing and including a lower base and a pair of spaced-apart columns sloping upward from the lower base so that upper portions of the columns engage corresponding top end caps attached at ends of a handle assembly there between, such that a handle of the handle assembly intersects a corresponding end cap and upper portion of a corresponding column. The end cap and upper portion have a semi-circular recess which mate to form a circular aperture around a corresponding handle end to secure the handle to the handle support structure. Each column has a central stanchion extending between a pair of posts to be received in its corresponding end cap, a fixed base support operatively attached to the handle support structure, and a bearing assembly operatively attached within the housing of the handle support structure to permit rotation of the contiguous handle, end caps and handle support structure by a user with the base support resting on a planar surface. However, there is no weight bearing part in this device to enable it for use as a dumbbell or kettlebell.

U.S. Pat. No. 7,553,259 discloses an exercise device comprising: a) a central grip having a longitudinal axis and b) a plurality of peripheral handles consisting of an odd number of handles, each peripheral handle having a peripheral grip portion extending between pairs of first and second radial portions, said first and second radial portions extending outward from said central grip, said central grip having a periphery at least ten percent greater than the periphery of at least one of the peripheral grip portions, and wherein the central grip has an outer surface comprising a plurality of curved sidewalls, each sidewall facing a respective peripheral grip portion. However, the enlarged central grip renders this device not suitable to use as a single hand dumbbell. Also, the radial portions do not provide sufficient surface area for the distribution of weight and hence have a high risk of damage.

U.S. Design Pat. No. 315,003 discloses a triangular dumbbell with three horizontal bars connecting to two triangular plates. There is no description on the size and usage of the dumbbell. However, there is a hole on each of the triangular plates and there is no inner handle. Without an inner handle, there is an uneven distribution of around any one of the horizontal bar. Hence this prior art does not function well as a dumbbell.

Most of the prior art merely discloses a single purpose exercising device. While other exercise devices may be used for multiple functions, they were typically bulky and not portable.

The present invention is substantially divergent in design elements from the prior art, and consequently it is clear that there is a need in the art for a multiple functions exercise device.

Any discussion of the prior art throughout the specification should in no way be considered as an admission that such prior art is widely known or forms part of common general knowledge in the field.

SUMMARY

Problems to be Solved

It is therefore an object of the present invention to provide a new and novel exercise device that is safe, ergonomically user friendly and has heretofore not been utilized.

It is an alternative object of the present invention to provide an exercise device that utilizes the knowledge of core stability to benefit natural muscular development through the core and abdomen.

Yet it is an alternative object of the present invention is to provide an exercise device that is easily grasped and comfortable to use.

Another alternative object of the present invention is to provide an exercise device that is functional for any exercise of choice. Thus, the device is very versatile and can be used for numerous exercises.

An alternative object of the present invention is to provide an exercise device that is cost effective and economical to manufacture, market and sell.

Also a further object of the present invention is to provide an exercise device that is aesthetically pleasing as it can even be made in different colours and or different patterns to satisfy individual male or female preferences.

It is an alternative object of the present invention to provide an exercise device that has the benefit of a kettle, a dumbbell, a medicine ball and a push-up stand.

Other objects and advantages will become apparent when taken into consideration with the following specification and drawings.

It is also an object of the present invention to overcome or ameliorate at least one of the disadvantages of the prior art, or to provide a useful alternative.

It is a first aspect of the present invention to provide an exercise device comprising: two regular convex polygon shaped load bearing plates having a center region and a peripheral region; a plurality of peripheral handles, each connecting to the peripheral region of the load bearing plates; an inner handle connecting to the center region of the load bearing plates; such that each of the peripheral handle and the inner handle has a longitudinal axis that is parallel to one another.

Preferably, each of the plurality of peripheral handles is at an apex of the load bearing plate.

Preferably, the inner handle is secured to the center of the load bearing plate.

Preferably, the regular convex polygon is a triangle.

Preferably, the load bearing plate and the peripheral handles are moulded as one cast metal.

Preferably, the peripheral handles are secured to the load bearing plates by welding.

Preferably, each of the peripheral handles comprises a finishing surface that is adapted for gripping.

Preferably, the peripheral handles have a length between 100 mm to 400 mm.

Preferably, the inner handle and the load bearing plates are moulded as one cast metal.

Preferably, the inner handle is secured to the load bearing plates by welding.

Preferably, the inner handle is removably attached to the load bearing plates by fastening means.

Preferably, the fastening means comprises any one or more of nut and bolt, pin, rivet, screw, and threads.

Preferably, the inner handle comprises a finishing surface that is adapted for gripping.

Preferably, the inner handle comprises a wrapping to facilitate gripping.

Preferably, the wrapping is made of a soft material.

Preferably, the soft material comprises any one or more of leather, vinyl or nylon.

Preferably, the inner handle passes through or passes relatively near the centroid of the exercise device.

Preferably, the load bearing plates have a curve surface.

Preferably, the load bearing plates is covered with a protective material.

Preferably, the protective material is one or more of leather, vinyl or nylon.

Preferably, the load bearing plates are made of heavy metal.

Preferably, the heavy metal includes any one or more of iron, steel, and alloy thereof.

Preferably, the exercise device further comprises a fitness system for collecting data and communicating to other electronic devices.

Preferably, the fitness system comprises one or more of sensors for collecting movement data.

Preferably, the sensors includes one or more of accelerometers, gyroscopes, or pedometers.

Preferably, the fitness system comprises a networking module for receiving and sending data.

Preferably, the networking module is adapted to communicate with other electronic device through any one or more wireless communication system including but in limited to WIFI™, BLUETOOTH™, or Near Field Communication.

It is another aspect of the present invention to provide an exercise device comprising: two load bearing plates having a regular convex polygon shape; a plurality of peripheral bars and an inner bar connecting to the two load bearing plates; wherein each of the peripheral bars has a longitudinal axis parallel to a longitudinal axis of the inner bar; such that an angular mass about the longitudinal axis of the inner bar is different to an angular mass about the longitudinal axis of any one of the peripheral bars.

Preferably, the regular convex polygon is a triangle.

Preferably, each of the peripheral bars is attached to an apex of the load bearing plates.

Preferably, the inner bar pass through a centroid of the exercise device.

BRIEF DESCRIPTION OF THE FIGURES

Other advantages of the present invention are readily appreciated as the same becomes better understood by reference to the following detailed description when considered in connection with the accompanying drawings wherein.

DESCRIPTION OF THE INVENTION

Referring to FIGS. 1 to 5, an embodiment of the present invention is shown to include an exercise device (10) comprising: two load bearing plates (12, 14), each of which has a regular convex polygon face with a center region and a peripheral region; a plurality of peripheral handles (20, 22, 24), each connecting to the peripheral region of the load bearing plate; an inner handle (18) connecting to the center region of the load bearing plates (12, 14); such that each of the peripheral handles (20, 22, 24) and the inner handle (18) has a longitudinal axis that is parallel to one another.

Figure 1:
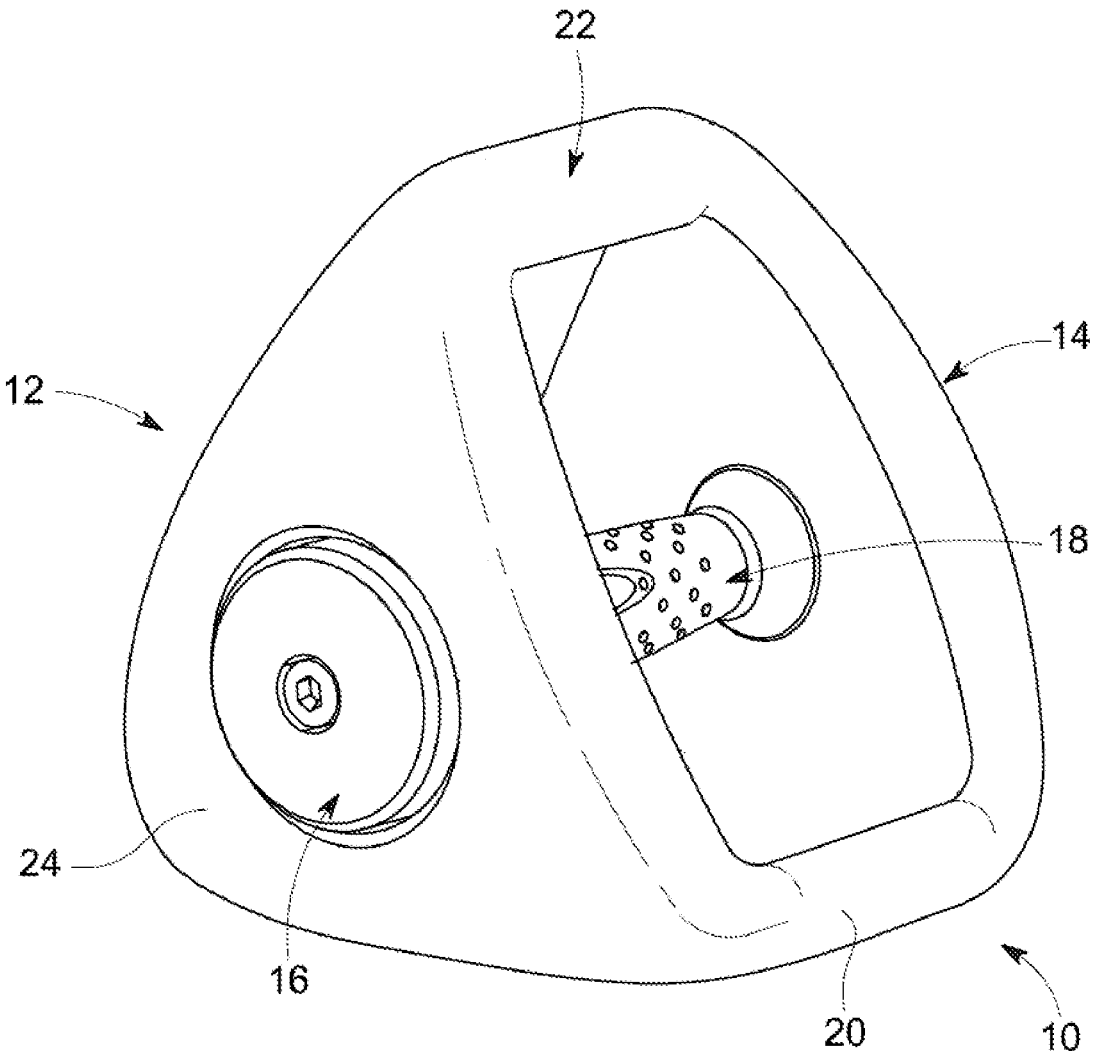
FIG. 1 is a schematic view of an exercise device according to an embodiment of the present invention.
Figure 2:
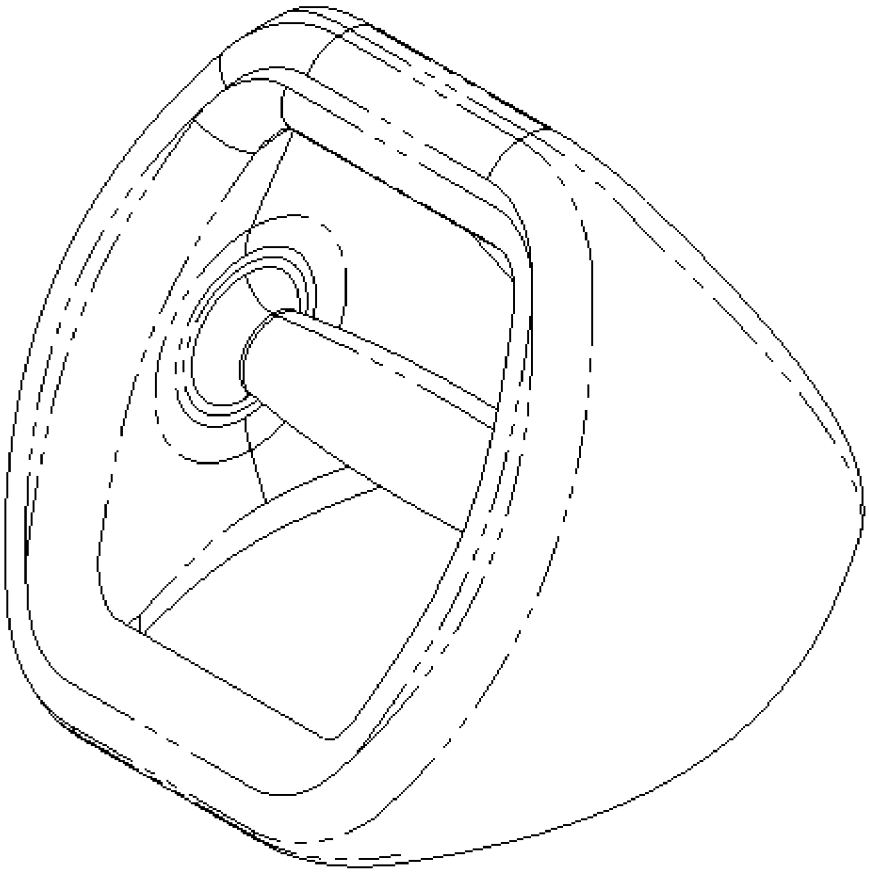
FIG. 2 is a schematic view of an exercise device according to another embodiment of the present invention.
Figure 3:
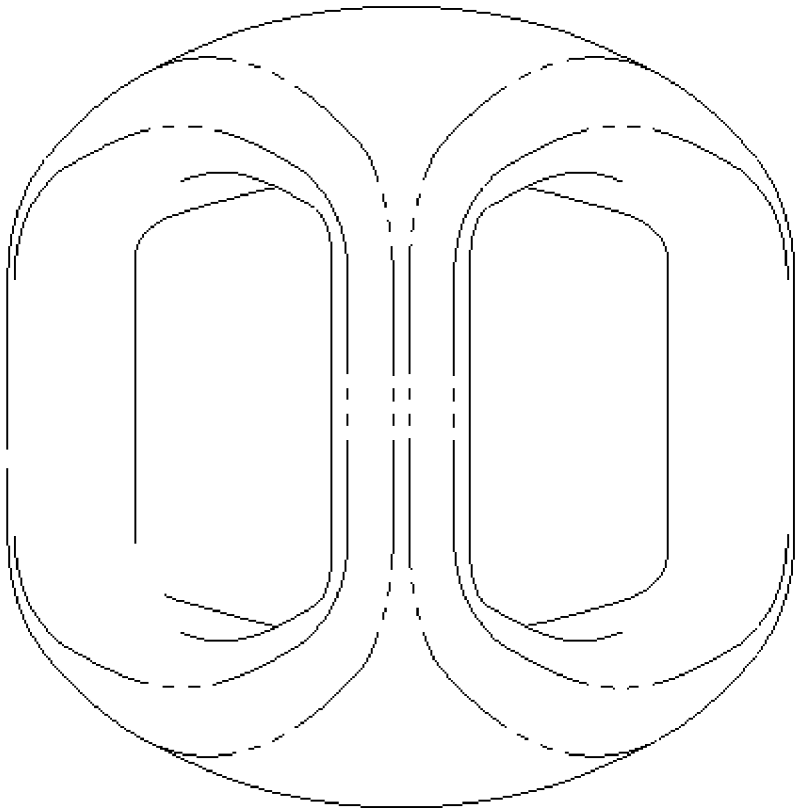
FIG. 3 is a top plan view of an exercise device of FIG. 2.
Figure 4:
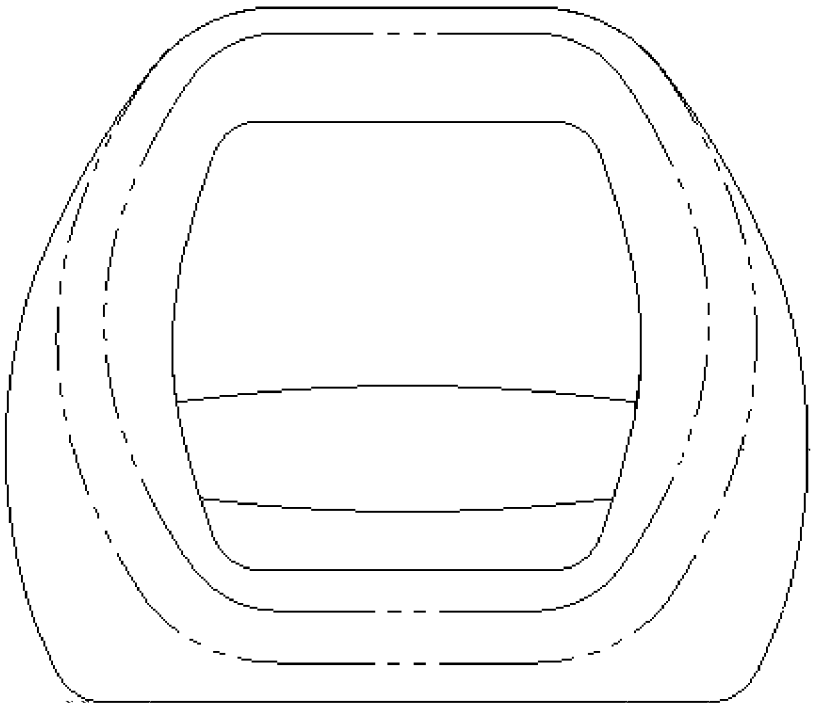
FIG. 4 is a front plan view of an exercise device of FIG. 2.
Figure 5:
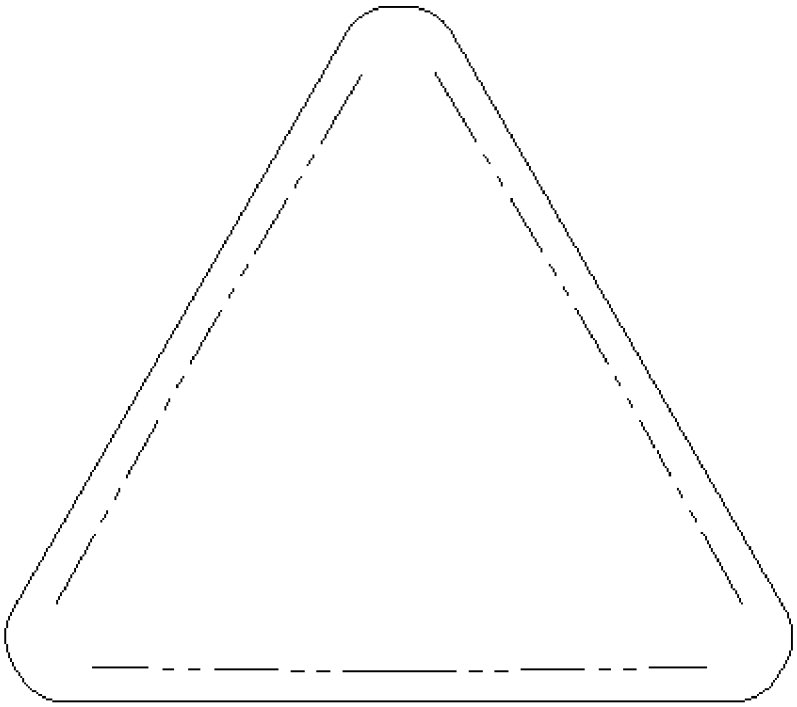
FIG. 5 is a side view of an exercise device of FIG. 2.

As shown in FIG. 1, the exercise device (10) comprises two opposite load bearing plates (12, 14) connected to each with a plurality of peripheral handles or bars (20, 22, 24). Each of the peripheral handles (20, 22, 24) has a longitudinal axis parallel to one another.

In one embodiment, the load bearing plates (12, 14) are triangular shaped. In another embodiment, the shape of the load bearing plates (12, 14) may be a pentagon, or other regular convex polygons. In another preferred embodiment, the shape of the load bearing plate (12, 14) may be any of the rouleaux polygon.

In one embodiment as shown in FIG. 1, the load bearing plates (12, 14) comprise one or more substantially flat surfaces such that the device (10) is adapted to rest on the ground steadily.

The regular convex polygon shape of the load bearing plates (12, 14) provides an efficient space for putting weight to the exercise device (10). This configuration allows the exercise device (10) remain compact while increasing the load. The current weight setting of the exercise device (10) of the present invention includes 3 kg, 6 kg, 9 kg, and 12 kg. It is envisaged that other weight settings may also be available. The benefit of having a regular convex polygon shaped load bearing plates (12, 14) is that it has a higher weight/volume ratio than that other shapes.

In a preferred embodiment, the peripheral handles (20, 22, 24) are located at the peripheral region that is near or at the apex of the load bearing plate (12, 14). Referring to FIG. 1, the shape of the load bearing plates (12, 14) is a triangle or a rouleaux triangle which comprises three apices. At each of the apices on the load bearing plates (12, 14), there is one peripheral handle (20, 22, 24). In total, there are three peripheral handles (20, 22, 24) in the preferred embodiment as shown in FIG. 1. Each of the peripheral handles (20, 22, 24) has a generally horizontal axis. Each of the joints between the peripheral handles (20, 22, 24) and the load bearing plates (12, 14) has a smooth concave finishing to facilitate holding.

In a preferred embodiment, the peripheral handle (20, 22, 24) has a length that is sufficient to accommodate two hands or around 10 mm to 40 mm. In such arrangement, the exercise device (10) can be carried at any one of the peripheral handles (20, 22, 24) with one or two hands. In another preferred embodiment, peripheral handle (20, 22, 24) has a substantially circular cross section.

In one preferred embodiment, the regular convex polygon shaped load bearing plates (12, 14) have round or fillet apex. Typically, the curvature of the around or fillet apex is the same as that of the peripheral handle (20, 22, 24).

In one preferred embodiment, the load bearing plates (12, 14) and the peripheral handles (20, 22, 24) are integrally formed as a single piece of cast metal as shown in FIGS. 2 to 5. In another embodiment, the peripheral handles (20, 22, 24) are secured to the load bearing plates (12, 14) by welding. In yet another embodiment, the peripheral handles (20, 22, 24) are secured to the load bearing plates (12, 14) with a fastener such as nuts and bolts, pins, screws, rivets, etc.

In one embodiment, the device (10) may be covered with a soft material such as leather, vinyl or nylon, which is stitched together into panels in order to create the smooth and soft surface. The surface material of the exercise device (10) is usually a material which has a natural friction to help a user easily grip and move the heavy device around without dropping it.

In one embodiment, the load bearing plates (12, 14) and the peripheral handles (20, 22, 24) defines a cavity in the exercise device (10) as shown in FIG. 1. Inside the cavity, the device (10) further comprises an inner handle (18) connecting to load bearing plates (12, 14) at the opposite side of the inner handle. Generally, the inner handle (18) has a longitudinal axis parallel to the longitudinal axis of the peripheral handles (20, 22 24).

In one embodiment, the inner handle (18) is inserted into the exercise device (10) from one side of a load bearing plate (12, or 14) through the cavity to another side of the load bearing plate (14, or 12). At the outer face of the load bearing plate (14, or 12), there is a locking plate (16) for securing the inner handle (18) to the load bearing plate. The locking plate (16) is secured to the inner handle (18) with a bolt. In one embodiment, the bolt securing the locking plate (16) to the inner handle (18) is a hexagon head bolt. The locking plate (16) has a big surface area which allows an even distribution of force to the load bearing plate (12, 14).

The inner handle (18) is located at the center region that is near the center of the load bearing plates (12, 14). In one preferred embodiment, the longitudinal axis of the inner handle (18) passes through the centroid of the exercise device (10). In one embodiment, the inner handle (18) has a soft wrapping disposed such as leather, vinyl or nylon.

Typically, the load bearing plates (12, 14) have an evenly distributed weight through the entire plate body. Preferably, the load bearing plates (12, 14) are made of heavy metal or alloy, such as iron, or steel etc.

In one preferred embodiment, the shape of load bearing plates (12, 14) is a regular convex polygon such that the angular masses about the longitudinal axis of the peripheral handles (20, 22, 24) are substantially equivalent. The inner handles is located inside the cavity such that the angular mass about the longitudinal axis of the inner handle is substantially different to that of the apex (18).

When in use the exercise device (10) can be held on the inner handle (18). In a preferred embodiment, the inner handle (18) has a longitudinal axis pass the centroid and hence should have the smallest angular mass. The weight is evenly distributed around the inner handle (18) and hence the exercise device (10) allows user to perform exercise in a more controlled manner. The exercise device in this status can function as a dumbbell.

In another application, the exercise device (10) can be held on one of the peripheral handles (20, 22, 24). In this status, the exercise device (10) functions as a kettlebell.

In yet another application, the exercise device (10) provides multiple handles for gripping and rolling. In this status, the exercise device (10) functions as a medicine ball.

In another application, the exercise device (10) can be place on the ground. The load bearing plate (12, 14) comprises a regular convex polygon face. This implies the face on each of the edges is rectangular shaped and forms a flat surface. The flat surface of the load bearing plate allows the exercise device (10) to stay steadily on the ground.

At the apex of the exercise device (10), there is provided a peripheral handle for a user to hold thereon. The regular convex polygon shaped load bearing plate (12, 14) provides a wide area for channeling forces exerted from the peripheral handle towards the flat surface of the load bearing plate on the ground. This configuration further enhances the stability of the exercise device on the ground. In this status, the exercise device functions as a push up stand.

In another preferred embodiment, the exercise device (10) comprises a fitness system comprising a number of sensors including an accelerometer, and a networking module. In operation, the sensors are adapted to collect exercise data including the speed and direction regarding the movement of the exercise device (10). The fitness system collects the data and forward it to a smart device or computer through the networking module.

In one preferable embodiment, the networking module is adapted to communicate with other electronic device through any one or more wireless communication system including but not limited to WIFI™, BLUETOOTH™, or Near Field Communication.

The smart device such as a smart phone or tablet may download a software application which is adapted to interpret the data forward.

The present invention and the described preferred embodiments specifically include at least one feature that is industrial applicable.

The invention claimed is:

1. An exercise device comprising:

two load bearing plates, each of which has a curved regular convex triangular face with a centre region and a peripheral region;

a plurality of peripheral handles, each connecting to the peripheral region of the load bearing plates;

an inner handle connecting to the centre region of the load bearing plates;

such that each of the peripheral handles and the inner handle have a longitudinal axis that is parallel to one another.

2. The exercise device according to claim 1, wherein the peripheral handles and the load bearing plates are connecting at joints each having a smooth concave finish.

3. The exercise device according to claim 1, wherein each of the plurality of peripheral handles is at an apex of the load bearing plate.

4. The exercise device according to claim 1, wherein the inner handle is secured to the centre of the load bearing plate.

5. The exercise device according to claim 1, wherein the load bearing plate and the peripheral handles are moulded as one cast metal.

6. The exercise device according to claim 1, wherein the peripheral handles are secured to the load bearing plates by welding.

7. The exercise device according to claim 1, wherein each of the peripheral handles comprises a finishing surface that is adapted for gripping.

8. The exercise device according to claim 1, wherein the peripheral handles have a length between 100 mm to 400 mm.

9. The exercise device according to claim 1, wherein the inner handle and the load bearing plates are moulded as one cast metal.

10. The exercise device according to claim 1, wherein the inner handle is secured to the load bearing plates by welding.

11. The exercise device according to claim 1, wherein the inner handle is removably attached to the load bearing plates by a fastener.

12. The exercise device according to claim 11, wherein the fastener comprises any one or more of nut and bolt, pin, rivet, screw, and threads.

13. The exercise device according to claim 1, wherein the inner handle comprises a finishing surface that is adapted for gripping.

14. The exercise device according to claim 1, wherein the inner handle comprises a wrapping to facilitate gripping.

15. The exercise device according to claim 14, wherein the wrapping is made of a soft material.

16. The exercise device according to claim 15, wherein the soft material comprises any one or more of leather, vinyl or nylon.

17. The exercise device according to claim 1, wherein the inner handle passes through or passes relatively near the centroid of the exercise device.

18. The exercise device according to claim 1, wherein the load bearing plates is covered with a protective material.

19. The exercise device according to claim 18, wherein the protective material is one or more of leather, vinyl or nylon.

20. The exercise device according to claim 1, wherein the load bearing plates are made of heavy metal.

21. The exercise device according to claim 20, wherein the heavy metal includes any one or more of iron, steel, and alloy thereof.

* * * * *